US007908989B2

(12) United States Patent
McLoughlin et al.

(10) Patent No.: US 7,908,989 B2
(45) Date of Patent: Mar. 22, 2011

(54) MULTI HULL WATER CRAFT

(75) Inventors: Simon McLoughlin, Ross-on-Wye (GB); Andrew McLoughlin, Ross-on-Wye (GB)

(73) Assignee: Makmarine Limited, Ross-on-Wye, Herefordshire (GB)

( * ) Notice: Subject to any disclaimer, the term of this patent is extended or adjusted under 35 U.S.C. 154(b) by 175 days.

(21) Appl. No.: 12/443,131

(22) PCT Filed: Oct. 17, 2007

(86) PCT No.: PCT/GB2007/003962

§ 371 (c)(1), (2), (4) Date: Mar. 26, 2009

(87) PCT Pub. No.: WO2008/053149

PCT Pub. Date: May 8, 2008

(65) Prior Publication Data

US 2010/0037810 A1 Feb. 18, 2010

(30) Foreign Application Priority Data

Oct. 31, 2006 (GB) ..... 0621701.2

(51) Int. Cl.
*B63B 1/24* (2006.01)

(52) U.S. Cl. ..... 114/274; 114/290

(58) Field of Classification Search ..... 114/274, 114/280, 288, 290

See application file for complete search history.

(56) References Cited

U.S. PATENT DOCUMENTS 3,354,857 A 11/1967 Hobday
3,604,384 A 9/1971 Coles
4,606,291 A * 8/1986 Hoppe ..... 114/274
4,665,853 A 5/1987 Gerdsen et al.
4,896,621 A 1/1990 Coles
4,951,591 A 8/1990 Coles
5,520,137 A * 5/1996 Arii et al. ..... 114/280

(Continued)

FOREIGN PATENT DOCUMENTS

EP 0051073 5/1982

(Continued)

OTHER PUBLICATIONS

International Search Report and Written Opinion dated Jan. 30, 2008, in International Application No. PCT/GB2007/003962.

(Continued)

*Primary Examiner* — Lars A Olson
(74) *Attorney, Agent, or Firm* — Downs Rachlin Martin PLLC

(57) ABSTRACT

The present invention relates to a water craft (10) having two spaced hulls (18, 20) and a tunnel (22) defined therebetween. The water craft (10) is provided with a hydrofoil section (38) extending between the hulls (18, 20) and across the tunnel (22). The tunnel facing side of each hull (18, 20) is provided with a recess (50) which extends from a position rearward of the bow (24) of the water craft (10) to the stern (26) of the water craft (10). Each recess (50) includes a side wall (52) which extends upwardly from the keel line of each hull (18, 20) and an upper wall (56) which is inclined downwardly in the direction of the stern (26). Each recess (50) is further provided at a rearward portion thereof with a skirt (58) positioned inboard of the side wall (52) so as to define an open sided channel between the skirt (58), sidewall (52) and downwardly inclined upper wall (56) of the recess (50).

21 Claims, 6 Drawing Sheets

U.S. PATENT DOCUMENTS

| | | | | |
|---|---|---|---|---|
| 5,570,649 | A | 11/1996 | Austin | |
| 6,164,235 | A * | 12/2000 | Hoppe | 114/280 |
| 6,729,258 | B1 * | 5/2004 | Fuglsang et al. | 114/274 |
| 6,895,883 | B2 | 5/2005 | Coles | |
| 2003/0029370 | A1 | 2/2003 | Coles | |
| 2005/0183650 | A1 | 8/2005 | Coles | |

FOREIGN PATENT DOCUMENTS

| | | |
|---|---|---|
| EP | 0094673 | 11/1983 |
| EP | 0249321 | 12/1987 |
| EP | 0614800 | 9/1994 |
| GB | 2088290 | 6/1982 |
| GB | 2121731 | 1/1984 |
| GB | 2341143 | 3/2000 |
| WO | 2006016915 | 2/2006 |

OTHER PUBLICATIONS

UK Patent Office Search Report dated Jan. 25, 2007, in priority application No. GB 0621701.2.

* cited by examiner

MULTI HULL WATER CRAFT

The present invention relates to a multi hulled water craft of the types typically known as catamarans and trimarans. Preferably, though not exclusively, the present invention relates to multi hulled water craft having a hydrofoil arrangement extending between the hulls.

When operating a planing water craft it is desirable to maintain a consistent range of longitudinal trim throughought the speed range, whilst minimising rolling and yawing motions, in order to achieve optimum comfort and efficiency. Factors which affect the trim of the water craft include the design of the hull, the longitudinal and lateral centres of gravity, engine trim and water and wind conditions. Variations in engine trim can often be used to overcome incorrect hull trim, however the trim of the engine can be difficult to set and can lead to inefficient engine operation due to misalignment of the propeller shaft. This in turn leads to increased fuel consumption, propeller cavitation and the need for constant engine trim adjustment to be made to take into account changes in, for example, the speed of the craft and the prevailing weather and water conditions.

In order to assist in trimming the craft correctly, transom mounted trim tabs may be installed. Typically such tabs are pivotably mounted at a location on the lower transom edge at a point where water, in use, exits rearwardly from a planing face of the hull. The tabs typically comprise flaps of a suitable sheet material which are inclined downwardly and rearwardly of the transom and are maintained in a desired position by struts. The struts may be fixed or adjustable in length. Where the struts are adjustable, extension and contraction of the or each strut results in changes to the inclination angle of the tab relative to the transom. In use, the resultant downward deflection of water exiting the planing face by the trim tab increases the hydrodynamic pressure underneath the trim tab. This increase in pressure causes the stern of the craft to rise and the consequently the bow of the craft to trim down as required.

There are a number of drawbacks with the use of adjustable trim tabs of the type described. Typically, an electromechanical system is required to move and maintain the trim tabs at a desired position. The system is exposed to a harsh environment and hence will require periodic maintenance. When the craft is stationary in the water, the trim tabs can impede swimmers boarding the craft via the transom. Also, the position of the trim tabs at the lower edge of the transom can potentially be damaged by floating debris and when moving the craft into and out of the water.

According to a first aspect of the present invention there is provided water craft having two spaced hulls and a tunnel defined therebetween, the water craft being further provided with a hydrofoil section extending between the hulls and across the tunnel, wherein the tunnel facing side of each hull is provided with a recess which extends from a position rearward of the bow of the hull to the stern of the hull, each recess including a side wall which extends upwardly from the keel line of the hull and an upper wall which is inclined downwardly in the direction of the stern, each recess further being provided at a rearward portion thereof with a skirt positioned inboard of the side wall so as to define an open sided channel between the skirt, side wall and downwardly inclined upper wall of the recess.

In use, water is directed into the recesses as a result of forward movement of the water craft. The water is conducted down each recess whereupon it impinges against the downwardly inclined upper wall of the recess. This creates lift in the region of the stern of the water-craft which in turn counteracts the tendency of the front of the craft to rise, for example due to acceleration of the water craft. The side walls of each recess, in use, prevent the lateral spillage of water out of each recess and into the tunnel.

The upper wall of each recess may be inclined over the entire length of the channel. In an alternative embodiment, the upper wall of each recess may be inclined over part of the length of the recess. In such an embodiment, the upper wall of each recess may be inclined from a position substantially midway along the length of the recess to the stern of the craft. The upper wall of each recess may be inclined in a straight line substantially constant gradient. In an alternative embodiment, the upper wall may be curved.

The upper wall of each recess may be formed integrally with the hull. For example, where the hull is manufactured from a fibre reinforced composite material the position and inclination of the upper wall may be defined by the mould or former upon which the fibre reinforced composite is laid up. In an alternative embodiment, the upper wall may be defined by a surface of an insert which is locatable in the recess. For example, the upper wall may be defined by the surface of a wedge shaped insert which is locatable in a recess of a hull. In such an embodiment, the recess may be of substantially constant cross-sectional dimensions over its length.

In an alternative embodiment the upper wall of the recess may be movable. In such an embodiment, the upper wall may be movable so as to alter the cross-sectional dimensions of the recess over its length, and hence alter the fluid flow characteristics through the recess. The upper wall of the recess may be flexible. In such an embodiment, the upper wall may be configured so as to resiliently deflect in response to the application of a predetermined load thereto. In an alternative embodiment, the upper wall may be connected to an actuator operable to move the upper wall to a desired location within the recess.

Each skirt preferably extends from a position rearward of the hydrofoil section to the stern of the water craft. The lowermost edge of each skirt may be provided at a position which is above both the hydrofoil section and the keel line of each hull.

The hydrofoil section preferably extends between the hulls at a position such that the channel of each hull extends both forward and aft of the hydrofoil section. The hydrofoil section is preferably provided at a position which is forward of the longitudinal centre of gravity of the water craft. The side wall of each channel preferably extends substantially perpendicularly with respect to the plane of the hydrofoil. The plane of the hydrofoil is preferably aligned with the keel line of each hull such that the side wall of each channel extends upwardly from the hydrofoil.

The hydrofoil section may be of any suitable shape or configuration. For example, the hydrofoil may be straight, curved or "v" shaped. Where "v" shaped, the vertex of the "v" preferably points in the direction of the stern of the water craft. The hydrofoil section may be supported only at each end where it meets the hulls. The hydrofoil section may additionally be supported at a position intermediate the ends thereof. For example, the hydrofoil section may be provided with a support member, such as a stay, extending from the hydrofoil section to a surface of the tunnel.

The water craft may be provided with one or more secondary hydrofoil sections. Where such secondary hydrofoil sections are provided, the aforementioned hydrofoil section may be termed a primary hydrofoil section. The or each secondary section is preferably positioned rearward of the primary hydrofoil section. The water craft may be provided with two secondary hydrofoil sections which extend into the tunnel from opposing faces of the hulls.

According to a second aspect of the present invention there is provided water craft having two spaced hulls and a tunnel defined therebetween, wherein the tunnel facing side of each hull is provided with a recess which extends from a position rearward of the bow of the hull to the stem of the hull, each recess including a side wall which extends upwardly from the keel line of the hull and an upper wall which is inclined downwardly in the direction of the stem, each recess further being provided at a rearward portion thereof with a skirt positioned inboard of the side wall so as to define an open sided channel between the skirt, side wall and downwardly inclined upper wall of the recess.

Features of the open sided channels common to the embodiment of the first aspect are equally applicable to the invention of the second aspect.

According to a third aspect of the present invention there is provided water craft having three spaced hulls comprising a centre hull and opposed outer hulls, and respective tunnel defined between each outer hull and the centre hull, the water craft being further provided with a hydrofoil section extending across the tunnels between each outer hull and the centre hull, wherein the tunnel facing side of each outer hull is provided with a recess which extends from a position rearward of the bow of the outer hull to the stern of the outer hull, each recess including a side wall which extends upwardly from the keel line of the hull and an upper wall which is inclined downwardly in the direction of the stem, each recess further being provided at a rearward portion thereof with a skirt positioned inboard of the side wall so as to define an open sided channel between the skirt, side wall and downwardly inclined upper wall of the recess.

Features of the invention described with reference to the first aspect are applicable to the invention of the third aspect.

According to a fourth aspect of the present invention there is provided water craft having three spaced hulls comprising a centre hull and opposed outer hulls, and a respective tunnel defined between each outer hull and the centre hull, wherein the tunnel facing side of each outer hull is provided with a recess which extends from a position rearward of the bow of the outer hull to the stern of the outer hull, each recess including a side wall which extends upwardly from the keel line of the hull and an upper wall which is inclined downwardly in the direction of the stem, each recess further being provided at a rearward portion thereof with a skirt positioned inboard of the side wall so as to define an open sided channel between the skirt, side wall and downwardly inclined upper wall of the recess.

Features of the open sided channels common to the embodiment of the first aspect are equally applicable to the invention of the fourth aspect.

Embodiments of the present invention will now be provided with reference to the accompanying drawings in which.

Figure 5A:
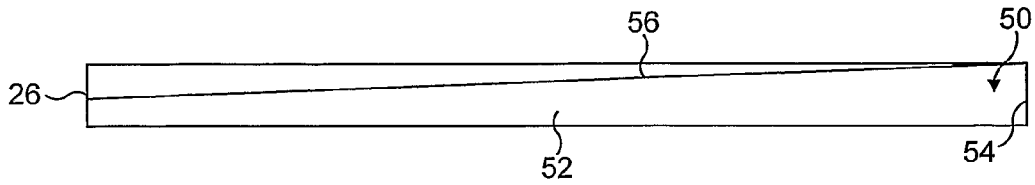
Figure 5B:
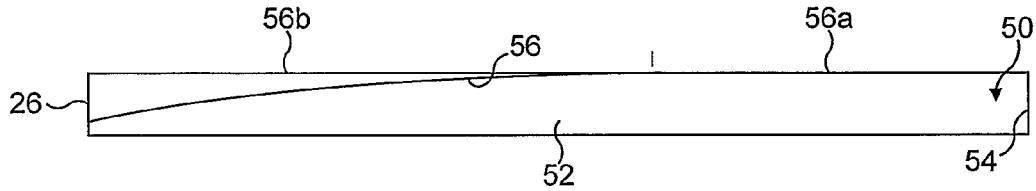
Figure 5C:
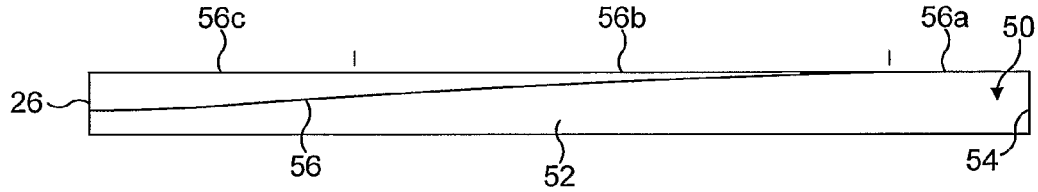
Figure 5D:
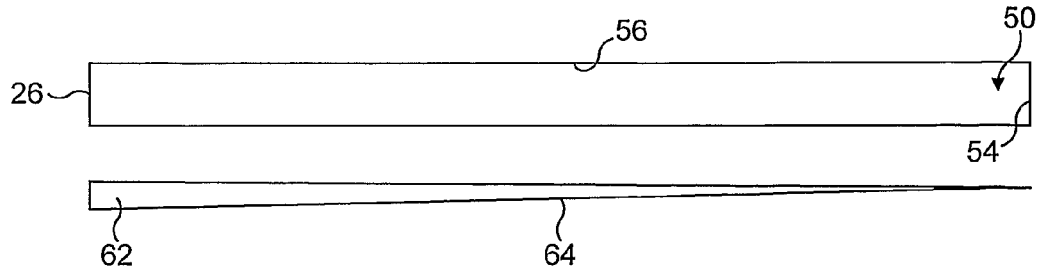
Figure 6A:
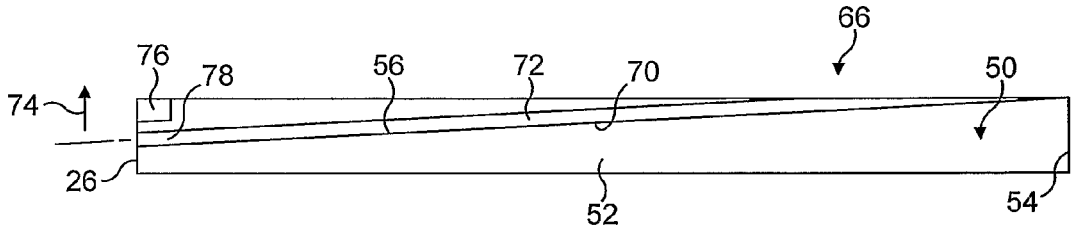
Figure 6B:
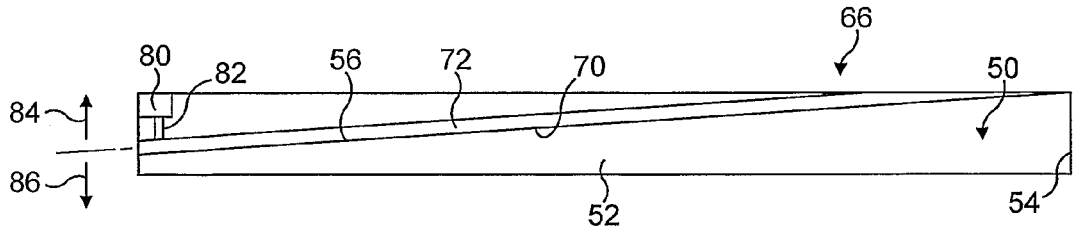

FIGS. 5*a* to 5*d* show side views of four different trim channel profiles; and FIGS. 6*a* and 6*b* show side views of two further trim channel arrangements.

Referring to the figures there is shown a twin hulled water craft generally designated 10. The craft 10 is of the rigid inflatable type and comprising a rigid hull member 12 having an inflatable tube 14 extending around the gunwale 16 thereof. The hull member 12 may be formed from, for example, wood, steel aluminium alloy and/or a fibre reinforced composite material such as glass fibre reinforced plastic. The inflatable tube may be manufactured from, for example, polyvinyl chloride, polyurethane or hypolon/neoprene composite. As described above, the hull member 12 is of the twin hull type and is provided with opposed hulls 18 and 20 separated by a tunnel 22 which extends from the bow 24 to the stem 26 of the craft 10. A keel 21 is defined at the lowest point of each hull 18, 20, which keel 21 extends in a fore to aft direction. The hulls 18, 20 are equidistantly spaced on opposing sides of the centreline 28 of the craft 10, whereas the tunnel 22 is aligned with the centreline 28 of the craft.

Figure 1:
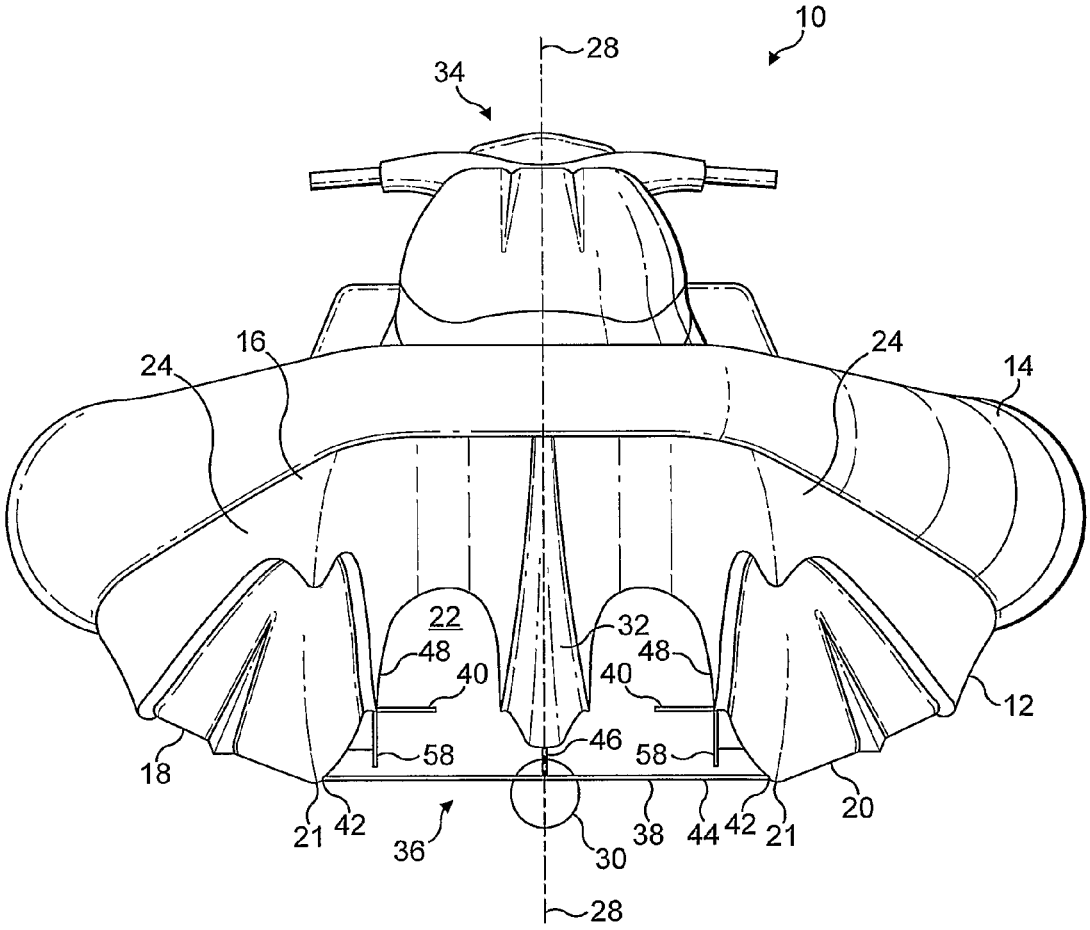
FIG. 1 is a front view of a water craft according to the present invention.

In the embodiment shown, the water craft 10 is configured for use with an outboard motor. In FIG. 1, the propeller housing 30 of an outboard motor mounted to the transom of the water craft 10 can be seen projecting below the rigid hull member 12. The transom may be provided at the stem 26 of the craft 10. Alternatively the transom may be stepped forward of the stem 26 of the craft 10. The rigid hull member 12 is provided with a centrally positioned deflector 32 which extends from the bow 24 towards the stem 26 and is aligned with the leg of the outboard motor so as to prevent the motor from being subjected to shock loadings from impacts with waves, floating debris and the like when the water craft 10 is in use. The presence of an outboard motor and the central deflector 32 are shown by way of example only and are not intended to limit the scope of the present invention.

The water craft 10 is further shown with a handlebar control interface 34 of the type which can be found on recreational personal water craft of the Jet Ski (tm) type. Again, this type of control interface is shown by way of example only and is not intended to be limiting upon the scope of the present invention.

Figure 2:
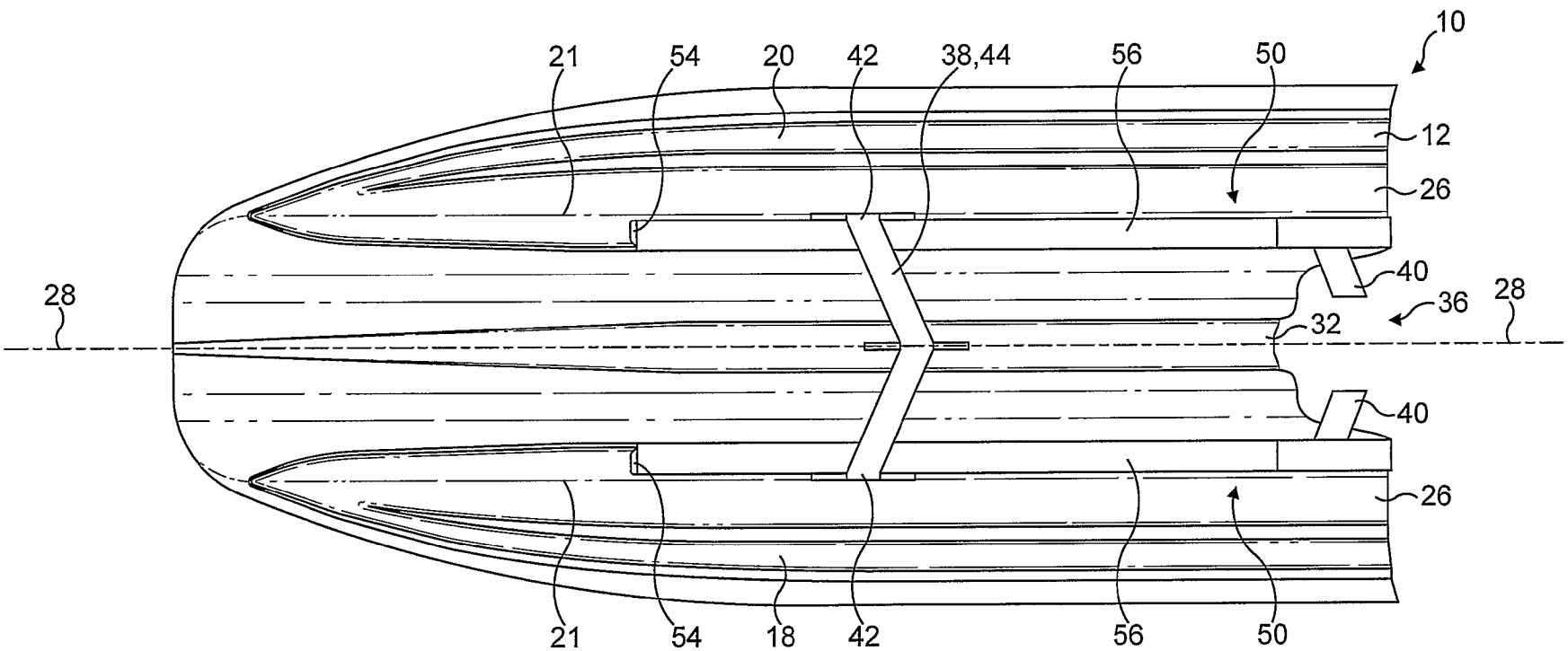
FIG. 2 is a bottom plan wire frame view of the rigid hull of the water craft of FIG. 1
Figure 3:
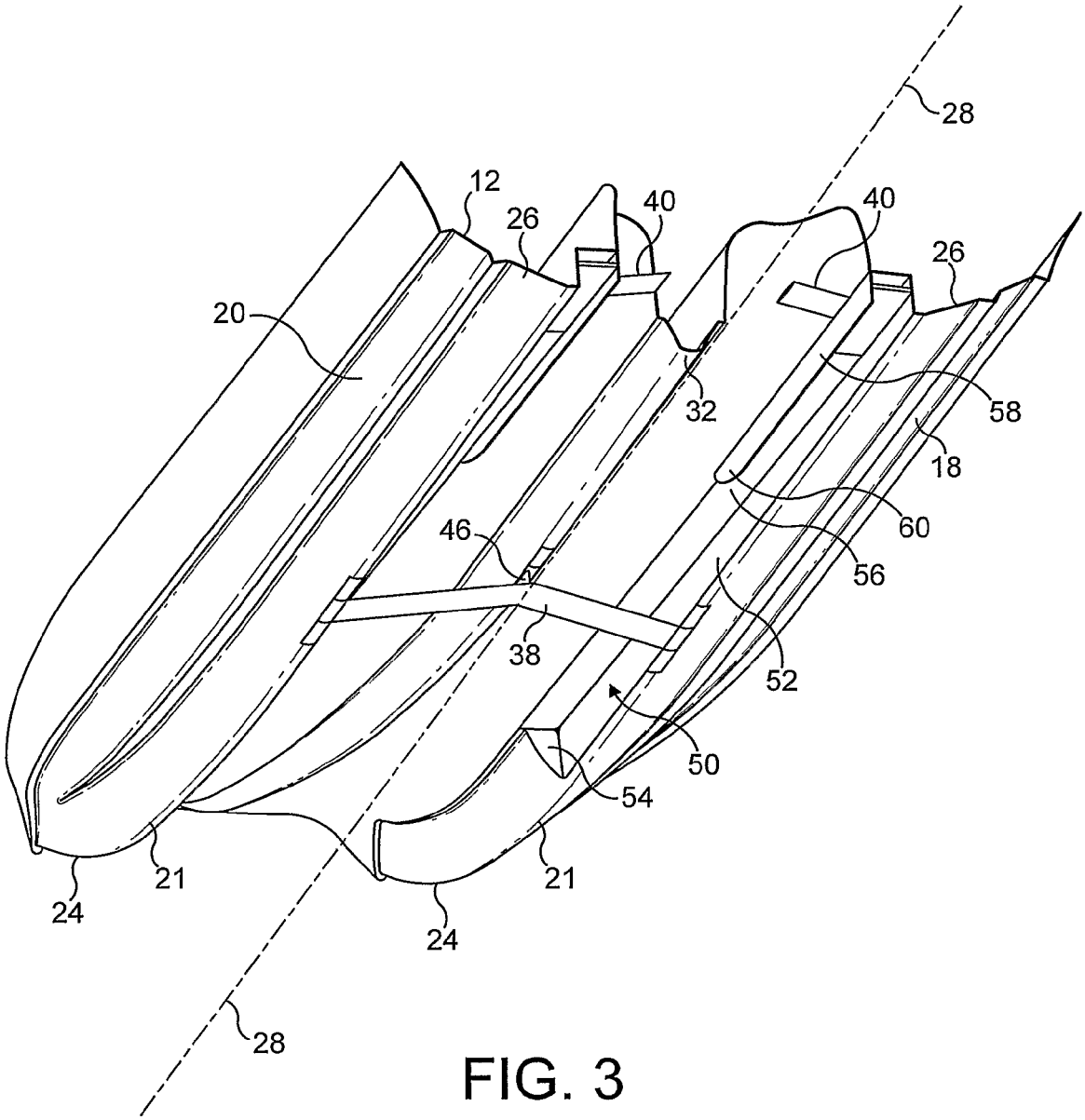
FIG. 3 is a partial wire frame view from below and to one side of the rigid hull of the water craft showing the hull trim channels.
Figure 4:
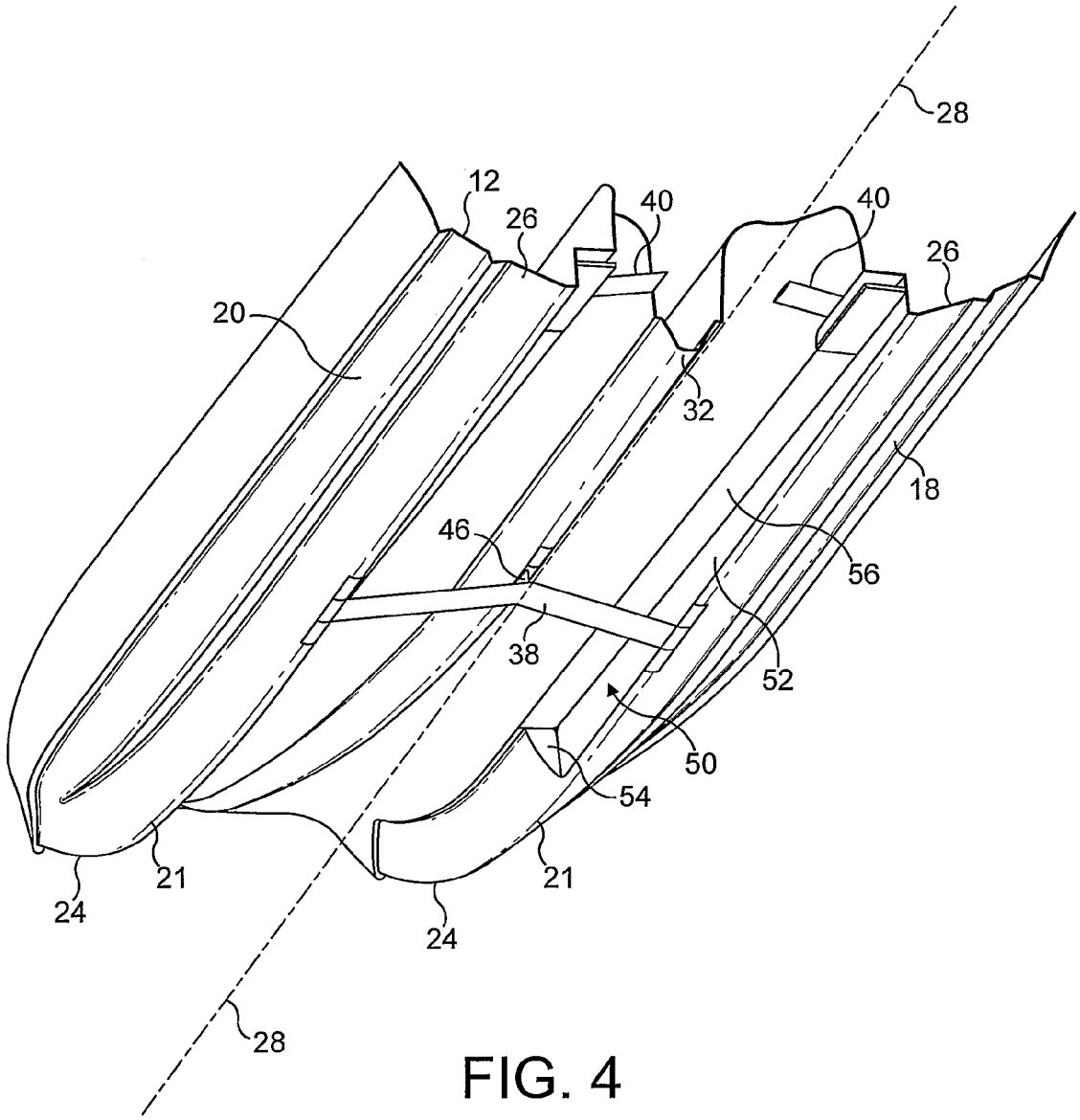
FIG. 4 is a further partial wire frame view from below and to one side of the rigid hull of the water craft with the side skirts of the trim channels removed.

The water craft 10 is further provided with a hydrofoil arrangement generally designated 36. The arrangement 36 comprises a primary foil 38 and two optional trim foils 40. The primary foil 38 extends between the hulls 18, 20 across the tunnel 22. Each trim foil 40 extends from a respective hull 18, 20 into the tunnel 22. As can readily be seen from FIG. 2, the primary foil is "v" shaped and is positioned such that the vertex of the "v" is aligned with the centreline 28 of the craft 10 and points in the direction of the stern. The respective outer ends 42 of the primary foil 38 are connected to the respective hulls 18, 20 at the keel 21 such that the lowermost surface 44 of the primary foil 38 is aligned with the keels 21. The primary foil 38 is further provided at its centre with an upwardly extending strut 46 which is connected to the deflector 32 of the hull member 12.

The primary foil 38 is located at a point which is forward of the longitudinal centre of gravity (LCG) of the craft 10. The specific positioning of the primary foil 38 forward of the LCG will depend upon the design of the hull member 12 and will vary from vessel to vessel. Each trim foil 40 extends from the tunnel facing wall 48 of the respective hull 18, 20 at vertical position above that of the primary foil 38. The trim foils 40 are inclined rearwardly towards the stern 26 so as to mirror the configuration of the primary foil 38 but do not project beyond the stern 26 of the craft 10. As can be seen from FIG. 1, the plane of the trim foils 40 is substantially parallel to the plane of the primary foil 38.

Each hull 18, 20 is further provided with a recess or trim channel generally designated 50 which faces the tunnel 22 between the hulls 18, 20. Each channel 50 extends from a point forward of the primary foil 38 and aft of the bow 24 of each hull 18, 20 to the stem 26 of the craft 10. Each channel 50 is defined by a side wall 52, a front wall 54 and an upper wall 56. The side wall 52 rises from the keel 21 and the lower edge of the side wall 52 follows the line of the keel 21. The upper wall 56 is inclined downwardly towards the stem 26 such that the height of the side wall 52 above the keel 21 reduces in the direction of the stern 26.

The rearward portion of each trim channel 50 is provided with a downwardly depending skirt 58 which is positioned inboard of the side wall 52 and lies substantially parallel to the side wall 52 of the trim channel 50. Each skirt 58 extends rearwardly from a position substantially midway between the primary and trim foils 38, 40 to the stern 36 of the craft 10. Each skirt 58 is planar and is provided with a fore portion 60 which curves upwardly in the direction of the hull member 12. It will be appreciated that each skirt 58, together with its respective side and upper walls 52, 56 defines an elongate conduit potion of the trim channel 50 which is closed on three sides and open to the front and to the rear to allow fluid to pass therethrough.

Operation of the craft 10 and the trim channels 50 will now be described. To aid in this description the wetted surfaces of the hulls 18, 20 and primary foil 38 will be termed the primary planing surfaces, and the portions of the upper walls 56 enclosed by the skirts 58 termed the secondary planing surfaces.

At rest, the craft 10 adopts a position whereupon the trim channels 50, primary and trim foils 38,40 are submerged below the waterline. As the craft 10 accelerates from stationary, the forward facing wetted surfaces of the hull member 12 and foils 38,40 generate lift. This lift causes the trim angle of the craft 10 to increase and the bow 24 to lift. The upper walls 56 of the trim channels 50 are thus lifted above the water surface and consequently fluid flow can commence through the trim channels 50 in the direction of the stern 26. In the rearward portion of the trim channel 50 the flow is constrained between the facing surfaces of the skirt 58 and side wall 52 and thus is cased to impinge upon the downwardly directed secondary planing surface of the upper wall 56. The impingement of the flow upon the secondary planing surface increases the pressure of the flowing fluid which in turn generates lift at the stern 26 of the craft 10. The inclination of the secondary planing surfaces ensures that a greater ratio of lift in generated at the stern 26 of the craft 10 than the lift generated by the primary planing surfaces. Accordingly, as the craft 10 passes the transition point from displacement to planing, it maintains a more consistent hull trim angle. It will be understood that the trim foils 40 act to assist the craft 10 in the transition from displacement to planing. When the craft 10 has risen onto the plane the trim foils 40 are raised clear of the surface of the water.

It will be appreciated that the secondary planing surfaces are positioned higher than the primary planing surfaces. As the speed of the craft 10 increases whilst planing, the hull member 12 rises up in the water with the result that the wetted surface area of the hull member 12 reduces. Consequently the amount of fluid entering and passing through the trim channels 50 reduces. As the hull member 12 adopts the correct trim angle for sustained planing on the primary planing surfaces, only the trailing edge of each trim channel 50 is in contact with the water. Accordingly, the pressure on the stern 26 of the craft 10 causing lift is greatly reduced. The provision of the trim channels 50 causes the stern 26 to lift, and hence the craft 10 to adopt the correct trim angle, when coming on to the plane and during low planing speeds. As the craft 10 accelerates to medium planing speeds the hull member 12 lifts from the water and hence lift generated by the secondary planing surfaces reduces. At high planing speeds, the secondary planing surfaces generate very little lift.

The advantages of the trim channels 50 can be summarised as follows. The lift generated by the secondary planing surfaces situated within the trim channels greatly assists in trimming the craft 10 correctly. The trim of the engine can thus be used for fine adjustment of the trim of the craft 10 and thereby reduce or eliminate the need for additional rearwardly extending trim tabs. The lift generated by the trim channels 50 is self regulating. At high speed, with the correct trim angle and the minimum wetted area of the primary planing surfaces, only the trailing edge of the secondary planing surfaces is in contact with the water. Consequently minimum drag is generated by the secondary planing surfaces. Substantially equal lift is generated at the rear of each hull 18, 20 with the effect that roll and yaw are reduced. The profile of the upper wall 56 of the trim channels 50 is fixed and hence does not need to be provided with adjustment means in the same manner as known movable trim tabs. The trim channels 50 are fully contained within the length of the hull member 12.

Referring now to FIGS. 5*a* to 5*d*, there are shown side views of differing trim channel configurations. Features common to the trim channels 50 described with reference to the FIGS. 1 to 4 are identified with like reference numerals. The channel 50 of FIG. 5*a* shows an upper wall 56 which is inclined linearly and has a constant gradient. The upper wall 56 is inclined for the full length of the channel 50. FIG. 5*b* shows an alternative configuration whereupon the upper wall 56 is curved. In the embodiment shown the fore portion 56*a* of the upper wall 56 is substantially straight, whereas the aft potion 56*b* is concave. FIG. 5*c* shows a further embodiment of a curved upper wall 56. The wall 56 has a sinuous shape and comprises a substantially straight for portion 56*a*, a concave mid portion 56*b*, and a convex aft portion 56*c*.

The upper wall 56 may be formed integrally with the hull member 12. Alternatively, the upper wall 56 may be defined by an insert 62 which is fittable to the channel 50. FIG. 5*d* shows a wedge shaped insert 62, which is fittable to a channel 50 having a substantially flat upper wall 57. In use, the lower face 64 of the insert 62 defines an inclined upper wall for the channel 50. The insert 62 may be retained to the channel 50 by any appropriate fixing means.

Referring now to FIGS. 6*a* and 6*b*, there are shown two additional trim channel configurations generally designated 66 and 68 respectively. Features common to the trim channels 50 described with reference to the FIGS. 1 to 5*b* are identified with like reference numerals.

In the configuration 66 shown in FIG. 6*a*, the upper wall 56 of the trim channel 50 is defined by the lower face 70 of an inclined planar member 72. The planar member 72 is connected to the hull member 12 at a forward end of the trim channel 50 and thus may be considered to be a form of cantilever. The planar member 72 is resiliently flexible and, in use, the distal tip 78 of the member 72 may deflect in the direction of the hull member 12 as indicated by arrow 74. The hull member 12 is provided with a stop 76 opposite the distal tip of the planar member 72 which acts to limit the deflection of the planar member 72. The deflection characteristics of the planar member 72 may be chosen such that the member 72 deflects in a predetermined manner once a known load is applied to the member 72. It will be appreciated that deflection of the planar member 72 in this manner would increase the cross-sectional area of the channel 50 and hence the flow of water through the channel can increase while the member 72 is deflected. Upon the removal of the applied load, the planar member 72 reverts to its pre-deflected position.

In the embodiment shown the stop 76 is fixed, and thus the maximum deflection distance of the distal tip 78 of the planer member 72 is limited. In an alternative embodiment the stop 76 may be configured so as to be movable both towards and away from the hull member. Accordingly, the maximum deflection distance of the distal tip of the planar member 72 may be varied. In such an embodiment, the position of the stop may be varied by a user of the watercraft, for example by a multi position switch or dial at or near the helm.

FIG. 6*b* shows a trim channel 50 having a configuration 68 similar to that shown in FIG. 6*a*, and common features are indicated with like reference numerals. The configuration 68 differs in that the distal tip 78 of the planar member 72 is connected to an actuator 80 positioned between the member 72 and the hull member 12. The actuator 80 includes an extensible ram 82 which is connected to the planar member 72 in the region of its distal tip 78. The ram 82 is movable as indicated by arrows 84 and 86 so as to alter the inclination and or curvature of the planar member 72 and hence modify the cross sectional shape, and consequently the fluid flow characteristics of the channel. As before, the position of the ram 82 may be varied by a user of the watercraft, for example by a multi position switch or dial at or near the helm.

The invention has been described with reference to a rib-type twin hulled craft 10 having a hydrofoil arrangement 36. It will be understood that the trim channels 50 of the present invention may be employed with water craft having other hull configurations. For example, the twin hull of the craft may be of the fully rigid type i.e. without an inflatable tube or tubes around the gunwale. The channels 50 of the present invention may be provided on a twin hulled water craft which is not provided with a hydrofoil arrangement and where the primary planing surfaces are defined by wetted surfaces of the hulls. The trim channels 50 of the present invention may be employed with a water craft having a triple hulled configuration. In such an embodiment a trim channel 50 of the type described may be provided on the inner face of each outer hull of the water craft. The triple hulled water craft may be provided either with or without a hydrofoil arrangement 36.

The invention claimed is:

1. A water craft having two spaced hulls and a tunnel defined therebetween, the water craft being further provided with a hydrofoil section extending between the hulls and across the tunnel, wherein the tunnel facing side of each hull is provided with a recess which extends from a position rearward of a bow of the water craft to a stern of the water craft, each recess including a side wall which extends upwardly from a keel line of each hull and an upper wall which is inclined downwardly in the direction of the stern, each recess further being provided at a rearward portion thereof with a skirt positioned inboard of the side wall so as to define an open sided channel between the skirt, side wall and downwardly inclined upper wall of the recess.

2. A water craft as claimed in claim 1 wherein the upper wall of each recess is inclined over the entire length of the recess.

3. A water craft as claimed in claim 1 wherein the upper wall of each recess is inclined over part of the length of the recess.

4. A water craft as claimed in claim 3 wherein the upper wall of each recess may be inclined from a position substantially midway along the length of the recess to the stern of the craft.

5. A water craft as claimed in claim 1 wherein the upper wall of each recess is inclined in a straight line of substantially constant gradient.

6. A water craft as claimed in claim l wherein the upper wall of each recess is curved.

7. A water craft as claimed in claim 1 wherein the upper wall of each recess is formed integrally with the hull.

8. A water craft as claimed in claim 1 wherein the upper wall of each recess is defined by a surface of an insert which is locatable in the recess.

9. A water craft as claimed in claim 1 wherein the upper wall of each recess is movable.

10. A water craft as claimed in claim 9 wherein the upper wall of each recess is resiliently flexible.

11. A water craft as claimed in claim 9 wherein the upper wall of each recess is connected to an actuator which is operable to move the upper wall.

12. A water craft as claimed in claim 1 wherein each skirt extends from a position rearward of the hydrofoil section to the stern of the water craft.

13. A water craft as claimed in claim 1 wherein the lowermost edge of each skirt is provided at a position which is above both the hydrofoil section and the keel line of each hull.

14. A water craft as claimed in claim 1 wherein the hydrofoil section extends between the hulls at a position such that the recess of each hull extends both forward and aft of the hydrofoil section.

15. A water craft as claimed in claim 1 wherein the side wall of each recess extends substantially perpendicularly with respect to the plane of the hydrofoil.

16. A water craft as claimed in claim 1 wherein the plane of the hydrofoil is aligned with the keel line of each hull such that the side wall of each channel extends upwardly from the hydrofoil.

17. A water craft as claimed in claim 1 wherein the hydrofoil section is supported at each end where it meets the hulls.

18. A water craft as claimed in claim 17 wherein the hydrofoil section is additionally be supported at a position intermediate the ends thereof.

19. A water craft as claimed in claim 18 wherein the hydrofoil section is provided with a support member which extends from the hydrofoil section to a surface of the tunnel.

20. A water craft as claimed in claim 1 wherein the water craft is provided with one or more secondary hydrofoil sections.

21. A water craft as claimed in claim 20 wherein the or each secondary hydrofoil section is positioned rearward of the primary hydrofoil section.

* * * * *

UNITED STATES PATENT AND TRADEMARK OFFICE

CERTIFICATE OF CORRECTION

PATENT NO. : 7,908,989 B2
APPLICATION NO. : 12/443131
DATED : March 22, 2011
INVENTOR(S) : Simon McLoughlin and Andrew McLoughlin It is certified that error appears in the above-identified patent and that said Letters Patent is hereby corrected as shown below:

In column 8, claim 18, line 45, after the word "additionally" delete the word "be".

Signed and Sealed this
Twentieth Day of December, 2011

David J. Kappos

David J. Kappos
*Director of the United States Patent and Trademark Office*